United States Patent [19]

Stillinger

[11] Patent Number: 4,756,529

[45] Date of Patent: Jul. 12, 1988

[54] GENERALLY SPHERICAL OBJECT WITH FLOPPY FILAMENTS TO PROMOTE SURE CAPTURE

[75] Inventor: Scott H. Stillinger, Los Gatos, Calif.

[73] Assignee: OddzOn Products, Campbell, Calif.

[21] Appl. No.: 60,640

[22] Filed: Jun. 11, 1987

[51] Int. Cl.[4] ..... A63B 37/14

[52] U.S. Cl. ..... 273/58 K; 273/428; 446/268; 446/490

[58] Field of Search ..... 446/490, 901, 268; 273/58 R, 58 J, 58 K, 199 R, 199 A, 415, 428; 15/244.1, 244.3

[56] References Cited

U.S. PATENT DOCUMENTS

| | | | |
|---|---|---|---|
| 2,290,216 | 7/1942 | Steinmetz et al. | 15/244.1 |
| 2,521,703 | 9/1950 | Emmitt | 273/58 K |
| 2,789,305 | 4/1957 | Weil | 15/244.1 |
| 3,759,518 | 9/1973 | Mroz | 273/58 K X |
| 4,131,276 | 12/1978 | Judkins | 273/58 C |
| 4,149,723 | 4/1979 | Simon | 273/428 X |
| 4,522,396 | 6/1985 | Girard et al. | 273/58 K |

FOREIGN PATENT DOCUMENTS

| | | | |
|---|---|---|---|
| 3121758 | 12/1982 | Fed. Rep. of Germany | 446/901 |

*Primary Examiner*—Richard T. Stouffer

*Attorney, Agent, or Firm*—Kolisch, Hartwell & Dickinson

[57] ABSTRACT

An amusement device which has a substantially spherical configuration, and which is formed from a large plurality of floppy, elastomeric filaments that radiate in a dense, bushy manner from a central core region. The filaments are sufficiently floppy to collapse on impact, thus to absorb enough energy to avoid any tendency to bounce. They are also sufficiently dense and floppy that they tend to quickly thread their way between the fingers of a user on contact with the hand. These features promote sure and quick capture of the device during the act of catching.

8 Claims, 2 Drawing Sheets

GENERALLY SPHERICAL OBJECT WITH FLOPPY FILAMENTS TO PROMOTE SURE CAPTURE

BACKGROUND AND SUMMARY OF THE INVENTION

This invention pertains to an amusement device, and more particularly, to a throwing/catching device which is especially easy to catch.

To youngsters who are just developing motor control, to youngsters and others who may have some motor control disfunctionality, as well as to many who simply enjoy throwing and catching, it is often difficult and frustrating to try to catch various typically available throwing/catching amusement devices, such as balls, etc.

One of the problems with many conventional throwing/catching devices is that, on impact, they do not absorb much energy, and accordingly, tend to bounce and get away from one's grasp easily. Also, they sometimes hurt to catch. Another problem is that, typically, they do not offer a surface configuration that promotes quick, sure gripping.

A general object of the present invention is to provide a unique amusement (throwing/catching) device which avoids these significant disadvantages in a very practical and satisfactory manner.

More particularly, an object of the invention is to provide such a device which tends to absorb a substantial amount of energy on impact through the act of collapsing, thereby avoiding any tendency to bounce and leap away from one's grip.

Yet another object of the invention is to provide a device of the type just generally outlined which has a surface characteristic that significantly promotes sure and quick grasping in a catch.

A further object of the invention is to provide a device such that suggested above which has a structure that prevents, because of wind resistance, throwing or hitting it very far, and which also eliminates the possibility of a catch that hurts.

An object related to the object just stated is to provide such a device which is extremely unlikely to break anything on contact.

According to a preferred embodiment of the invention, the same takes the form of a plurality of elongate, floppy, elastomeric-like filaments which are somewhat spaghetti-like in aspect, and which are joined in a core region in such a manner that they radiate outwardly, in plural offset planes, in a dense, bushy fashion to create a substantially spherical object. Preferably, the surfaces of these filaments, whether by treatment or just because of the nature of the material used in them, have frictioning characteristics which make them tend to cling to, rather than slide in, a person's hand.

Other objects, and the various important advantages offered by the invention, will now become more fully apparent when the description which follows is read in conjunction with the accompanying drawings.

DETAILED DESCRIPTION OF THE INVENTION

Figure 1:
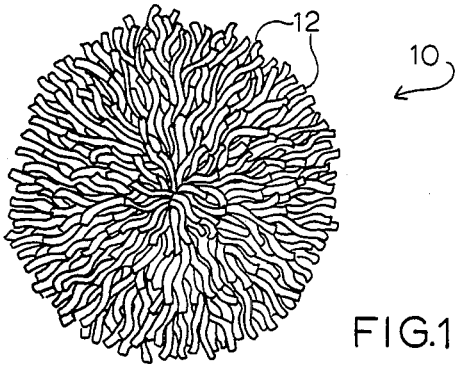
FIG. 1 is a view showing an amusement device constructed in accordance with the invention.

Turning now to the drawings, and referring first of all to FIG. 1, indicated generally at 10 is a preferred embodiment of a throwing/catching amusement device constructed in accordance with the present invention. As will become apparent, this device offers remarkable and reliable, no-injury catchability. It is especially suitable, inter alia, for people, youngsters or others, who have motor control difficulties vis-a-vis quickly gripping a thrown object.

Device 10 is formed with a large plurality of elongate, floppy, elastomeric filaments 12, each of which, as is clearly evident in FIG. 1, has cross-sectional dimensions which are extremely small in relation to the length of the filament. As will be more fully explained shortly, these filaments are joined in a central core region in such a manner that they radiate outwardly in a fairly uniform, dense and bushy fashion, in multiple angularly offset planes, to form a substantially spherical configuration. While the outside diameter of device 10 may be of any desired size, I have found that a very satisfactory diameter lies in the range of about 3- to about 5-inches.

Preferably, although not necessarily, the surfaces of filaments 12, either by virtue of surface treatment, or simply because of the inherent nature of the material chosen, have a frictioning characteristic which makes them tend to grip, rather than to slide or slip on, a person's skin. A material which I have found to be very useful for these filaments is extruded natural rubber.

Figure 2:
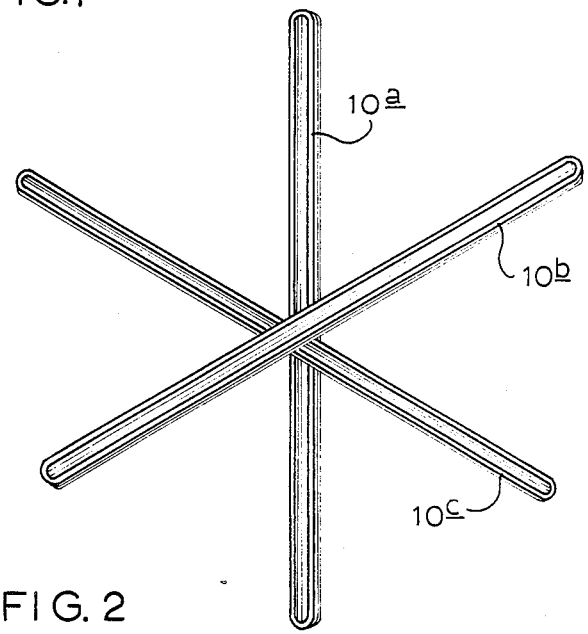
FIG. 2 shows the device of FIG. 1 in an early assembly stage.
Figure 3:
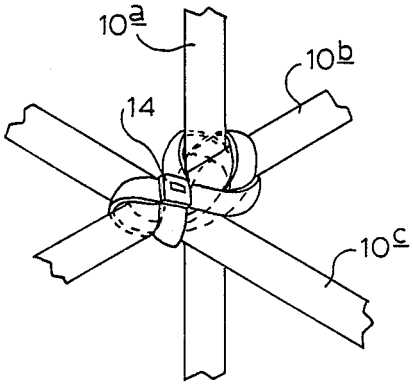
FIG. 3 is an enlarged detail of the central portion of FIG. 2 showing the device of the invention in a slightly later stage of construction.

While, to be sure, various techniques and devices may be used for joining these filaments to produce the desired resultant object, device 10 has been formed, as is illustrated in FIGS. 2 and 3.

Referring first to FIG. 2, three long lengths of extruded rubber filaments are each wound in a pattern of reverse bend loops and then stretched as loops to lengths of about 16-inches typically. The three stretched loop units are then placed relative to one another along three orthogonal axis. This is shown at 10*a*, 10*b*, 10*c* in FIG. 2. Next, and now referring to FIG. 3, a conventional cinching device 14 is wound as illustrated where the wound filament loops centrally cross one another, and drawn tight to gather them. The reverse-bend ends (six ends) are then cut, with the result that the stretched filaments spring back toward their gathered centers, with a natural tendency to fan out radially in all planes to have the substantially spherical form which is desired.

Figure 4:
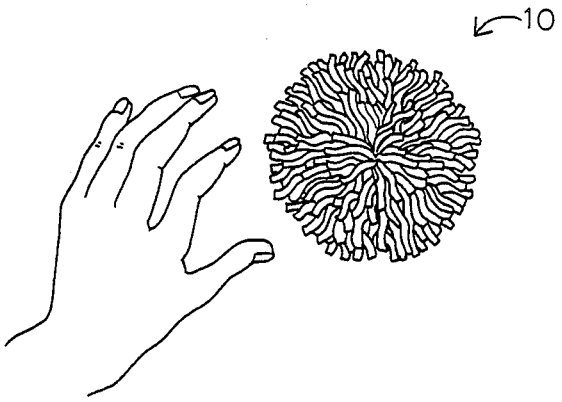
FIG. 4 shows the device of the invention about to be caught in a person's hand.
Figure 5:
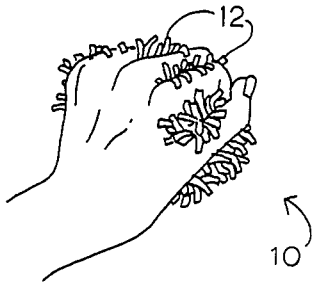
FIG. 5 shows the device in a caught condition.

As one should easily be able to imagine from the description which has just been given, device 10 is extremely simple to catch. The floppy filaments cause the device to collapse significantly upon impact, thus to absorb energy and resist bouncing away. The high plurality of tiny filaments offers substantial gripping surface area, and the filaments, on contact with the hand, tend quickly to thread their way between the fingers and thus further promote sure and quick catching. This situation is clearly depicted in FIGS. 4 and 5. Aiding in this respect even more is the fact that the surfaces of the filaments herein have a high-frictioning characteristic.

Obviously, because of the nature of device 10 as just described, it is virtually impossible to hurt one self while catching it. Also, the device is unlikely to break any object which it might hit.

Clearly, the device is extremely simple and inexpensive in construction.

The specific nature of device 10 can be altered, of course, by changing cross-sectional dimensions, cross-sectional aspect ratios and specific materials employed for the filaments and curliness.

Figure 6:
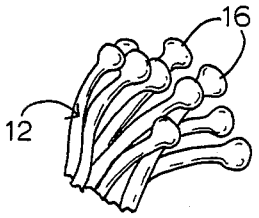
FIGS. 6 and 7 are fragmentary details showing two different modified forms of the invention.
Figure 7:
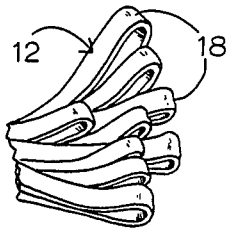

Two other ways of modifying the device are illustrated respectively in FIG. 6 and 7. For example, in FIG. 6, the outer ends of the filaments are formed with enlargements 16. In FIG. 7, the filaments take the form of reversely bent loops 18.

Figure 8:
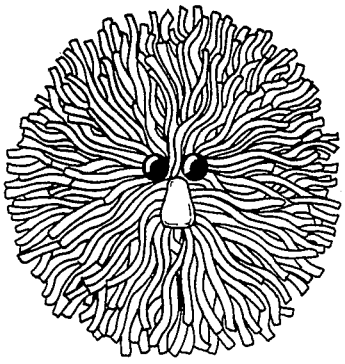
FIG. 8 is an aesthetically modified form of the invention to give it a humorous, critter-like visual appeal.

Finally, designed more especially for youngsters, and illustrated in FIG. 8, is a somewhat humorous, critter-like modification, where a small side portion of the core region bears humorous face-like features. These can, of course, be made in any desired way.

It should be apparent now how the device proposed by the present invention meets all of the objects, and offers all of the advantages, expressed and suggested herein. While a preferred embodiment of the device, and certain modifications, have been described herein, it is appreciated that other variations and modifications may be made without departing from the spirit of the invention.

It is claimed and desired to secure by Letters Patent:

1. An amusement device comprising a core region, and plural, elongate, floppy, tiny-diameter, elastomeric filaments, each having a cross-sectional dimension which is extremely small in relation to its length, said filaments radiating in plural angularly offset planes in a dense, bushy configuration from said core region to form a generally spherical object, with the filaments being sufficiently floppy to collapse significantly on impact, thus to absorb enough energy to avoid any tendency to bounce, and with the filaments being sufficiently dense and floppy that a large plurality thereof tend to thread their way between adjacent fingers of a user's hand upon contact of the filaments with the hand during the act of catching, thereby to promote sure and quick capture of the device.

2. The device of claim 1, wherein the outer ends of at least some of the filaments include enlargements.

3. The device of claim 1, wherein each of said filaments, where it radiates from the core region, takes the form of a reverse bend.

4. The device of claims 1, 2 or 3, wherein the surfaces of said filaments have frictioning characteristics.

5. An amusement comprising a plurality of elongate, floppy, tiny-diameter, elastomeric filaments, each having a cross-sectional dimension which is extremely small in relation to its length, and means joining said filaments intermediate their ends in such a manner that they radiate from a core region to form a dense, bushy configuration, said filaments collectively forming a generally spherical object, and being sufficiently floppy to collapse significantly on impact, thus to absorb enough energy to avoid any tendency to bounce, with the filaments being sufficiently dense and floppy that a large plurality thereof tend to thread their way between adjacent fingers of a user's hand upon contact with the hand during the act of catching, thus to promote sure and quick capture of the device.

6. The device of claim 5, wherein said joining means comprises means cinching and gathering the filaments intermediate their ends.

7. The device of claim 6, wherein said filaments have substantially the same lengths.

8. The device of claims 5, 6 or 7, wherein the surfaces of said filaments have frictioning characteristics.

* * * * *